US006461253B2

(12) United States Patent
Ogg

(10) Patent No.: US 6,461,253 B2
(45) **Date of Patent: *Oct. 8, 2002**

(54) AERODYNAMIC SURFACE GEOMETRY FOR A GOLF BALL

(75) Inventor: Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/872,808

(22) Filed: Jun. 1, 2001

(65) Prior Publication Data

US 2001/0036873 A1 Nov. 1, 2001

Related U.S. Application Data

(63) Continuation-in-part of application No. 09/443,088, filed on Nov. 18, 1999, now Pat. No. 6,290,615.

(51) Int. Cl.[7] ..... A63B 37/12
(52) U.S. Cl. ..... 473/378
(58) Field of Search ..... 473/378–384

(56) References Cited

U.S. PATENT DOCUMENTS

| | | | | |
|---|---|---|---|---|
| 2,002,726 A | | 5/1935 | Young | |
| 3,227,456 A | | 1/1966 | Sonneman | |
| 4,090,716 A | | 5/1978 | Martin et al. | |
| 4,266,773 A | | 5/1981 | Treadwell | |
| 4,787,638 A | | 11/1988 | Kobayashi | |
| 4,836,552 A | * | 6/1989 | Puckett et al. | 473/383 |
| 5,062,644 A | | 11/1991 | Lee | |
| 5,064,199 A | | 11/1991 | Morell | |
| 5,308,076 A | | 5/1994 | Sun | |
| 5,441,276 A | | 8/1995 | Lim | |
| 5,536,013 A | | 7/1996 | Pocklington | |
| 5,575,477 A | | 11/1996 | Hwang | |
| 5,857,924 A | | 1/1999 | Miyagawa et al. | |
| 5,863,264 A | | 1/1999 | Yamagishi et al. | |
| 5,906,551 A | | 5/1999 | Kasashima et al. | |
| 5,908,359 A | | 6/1999 | Shimosaka et al. | |
| 5,916,044 A | | 6/1999 | Shimosaka et al. | |
| 5,935,023 A | | 8/1999 | Machara et al. | |
| 6,290,615 B1 | * | 9/2001 | Ogg | 473/378 |
| D449,358 S | * | 10/2001 | Ogg | 473/378 |

* cited by examiner

*Primary Examiner*—Mark S. Graham
*Assistant Examiner*—Raeann Gorden
(74) *Attorney, Agent, or Firm*—Michael A. Catania

(57) ABSTRACT

A golf ball approaching zero land area is disclosed herein. The golf ball has an innersphere with a plurality of lattice members. Each of the plurality of lattice members has an apex and the golf ball of the present invention conforms with the 1.68 inches requirement for USGA approved golf balls. The interconnected lattice members form a plurality of hexagons and pentagons in the preferred embodiment. The preferred embodiment has a parting line that alternates upward and downward along adjacent rows of hexagons.

5 Claims, 15 Drawing Sheets

AERODYNAMIC SURFACE GEOMETRY FOR A GOLF BALL

CROSS REFERENCES TO RELATED APPLICATIONS

The present application is a continuation-in-part application of U.S. patent application Ser. No. 09/443,088, filed on Nov. 18, 1999, now U.S. Pat. No. 6,290,615.

BACKGROUND OF THE INVENTION

1. Field of the Invention

The present invention relates to an aerodynamic surface geometry for a golf ball. More specifically, the present invention relates to a golf ball having a lattice structure and an innersphere.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a British patent for a golf ball with indentations (dimples) that flew better ad more accurately than golf balls with brambles. A.G. Spalding & Bros., purchased the U.S. rights to the patent (embodied possibly in U.S. Pat. No. 1,286,834 issued in 1918) and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octohedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's. A combination of a mesh pattern and dimples is disclosed in Young, U.S. Pat. No. 2,002,726, for a Golf Ball, which issued in 1935.

The traditional golf ball, as readily accepted by the consuming public, is spherical with a plurality of dimples, with each dimple having a circular cross-section. Many golf balls have been disclosed that break with this tradition, however, for the most part these non-traditional golf balls have been commercially unsuccessful.

Most of these non-traditional golf balls still attempt to adhere to the Rules Of Golf as set forth by the United States Golf Association ("USGA") and The Royal and Ancient Golf Club of Saint Andrews ("R&A"). As set forth in Appendix III of the Rules of Golf, the weight of the ball shall not be greater than 1.620 ounces avoirdupois (45.93 gm), the diameter of the ball shall be not less than 1.680 inches (42.67 mm) which is satisfied if, under its own weight, a ball falls through a 1.680 inches diameter ring gauge in fewer than 25 out of 100 randomly selected positions, the test being carried out at a temperature of 23±1° C., and the ball must not be designed, manufactured or intentionally modified to have properties which differ from those of a spherically symmetrical ball.

One example is Shimosaka et al., U.S. Pat. No. 5,916,044, for a Golf Ball that discloses the use of protrusions to meet the 1.68 inch (42.67mm) diameter limitation of the USGA and R&A. The Shimosaka patent discloses a golf ball with a plurality of dimples on the surface and a few rows of protrusions that have a height of 0.001 to 1.0 mm from the surface. Thus, the diameter of the land area is less than 42.67 mm.

Another example of a non-traditional golf ball is Puckett et al., U.S. Pat. No. 4,836,552 for a Short Distance Golf Ball, which discloses a golf ball having brambles instead of dimples in order to reduce the flight distance to half of that of a traditional golf ball in order to play on short distance courses.

Another example of a non-traditional golf ball is Pocklington, U.S. Pat. No. 5,536,013 for a Golf Ball, which discloses a golf ball having raised portions within each dimple, and also discloses dimples of varying geometric shapes such as squares, diamonds and pentagons. The raised portions in each of the dimples of Pocklington assists in controlling the overall volume of the dimples.

Another example is Kobayashi, U.S. Pat. No. 4,787,638 for a Golf Ball, which discloses a golf ball having dimples with indentations within each of the dimples. The indentations in the dimples of Kobayashi are to reduce the air pressure drag at low speeds in order to increase the distance.

Yet another example is Treadwell, U.S. Pat. No. 4,266,773 for a Golf Ball, which discloses a golf ball having rough bands and smooth bands on its surface in order to trip the boundary layer of air flow during flight of the golf ball.

Aoyama, U.S. Pat. No. 4,830,378, for a Golf Ball With Uniform Land Configuration, discloses a golf ball with dimples that have triangular shapes. The total flat land area of Aoyama is no greater than 20% of the surface of the golf ball, and the objective of the patent is to optimize the uniform land configuration and not the dimples.

Another variation in the shape of the dimples is set forth in Steifel, U.S. Pat. No. 5,890,975 for a Golf Ball And Method Of Forming Dimples Thereon. Some of the dimples of Steifel are elongated to have an elliptical cross-section instead of a circular cross-section. The elongated dimples make it possible to increase the surface coverage area. A design patent to Steifel, U.S. Pat. No. 406,623, has all elongated dimples.

A variation on this theme is set forth in Moriyama et al., U.S. Pat. No. 5,722,903, for a Golf Ball, which discloses a golf ball with traditional dimples and oval shaped dimples.

A further example of a non-traditional golf ball is set forth in Shaw et al., U.S. Pat. No. 4,722,529, for Golf Balls, which discloses a golf ball with dimples and 30 bald patches in the shape of a dumbbell for improvements in aerodynamics.

Another example of a non-traditional golf ball is Cadomiga, U.S. Pat. No. 5,470,076, for a Golf Ball, which discloses each of a plurality of dimples having an additional recess. It is believed that the major and minor recess dimples of Cadomiga create a smaller wake of air during flight of a golf ball.

Oka et al., U.S. Pat. No. 5,143,377, for a Golf Ball, discloses circular and non-circular dimples. The non-circular dimples are square, regular octagonal, regular hexagonal and amount to at least forty percent of the 332 dimples on the golf ball of Oka. These non-circular dimples of Oka have a double slope that sweeps air away from the periphery in order to make the air turbulent.

Machin, U.S. Pat. No. 5,377,989, for Golf Balls With Isodiametrical Dimples, discloses a golf ball having dimples with an odd number of curved sides and arcuate apices to reduce the drag on the golf ball during flight.

Lavallee et al., U.S. Pat. No. 5,356,150, discloses a golf ball having overlapping elongated dimples to obtain maximum dimple coverage on the surface of the golf ball.

Oka et al., U.S. Pat. No. 5,338,039, discloses a golf ball having at least forty percent of its dimples with a polygonal shape. The shapes of the Oka golf ball are pentagonal, hexagonal and octagonal.

Although the prior art has set forth numerous variations for the surface of a golf ball, there remains a need for a golf ball having a surface that minimizes the volume needed to trip the boundary layer of air at low speed while providing a low drag level at high speeds.

BRIEF SUMMARY OF THE INVENTION

The present invention is able to provide a golf ball that meets the USGA requirements, and provides a minimum land area to trip the boundary layer of air surrounding a golf ball during flight in order to create the necessary turbulence for greater distance. The present invention is able to accomplish this by providing a golf ball with an outersphere defined by a lattice structure and an innersphere.

One aspect of the present invention is a golf ball with an innersphere having a surface and a plurality of lattice members that define an outersphere. Each of the lattice members has a cross-sectional contour with an apex at the greatest extent from the center of the golf ball, which define the outersphere. The plurality of lattice members are connected to each other to form a predetermined pattern on the golf ball.

The plurality of lattice members on the golf ball may cover between 20% to 80% of the golf ball. The apex of each of the plurality of lattice members has a width less than 0.00001 inch resulting in a minimal land area for the outersphere. The diameter of the innersphere may be at least 1.67 inches and the apex of each of the plurality of lattice members may have a distance of at least 0.005 inch from the bottom of the lattice member resulting in a diameter of the outersphere of at least 1.68 inches. The golf ball may also include a plurality of smooth portions on the innersphere surface wherein the plurality of smooth portions and the plurality of lattice members cover the entire golf ball.

Another aspect of the present invention is a golf ball having an innersphere with a surface and a plurality of lattice members with apices that define an outersphere. Each of the lattice members has a cross-sectional curvature with an arc. Each of the plurality of lattice members is connected to each other to form a plurality of interconnected polygons. The lattice members cover between 20% and 80% of the golf ball.

Yet another aspect of the present invention is a golf ball having a sphere with a tubular lattice configuration. The sphere has a diameter in the range of 1.60 to 1.70 inches. The tubular lattice configuration includes a plurality of lattice members. Each of the lattice members has an apex that has a distance from the bottom of each lattice member in a range of 0.005 to 0.010 inch resulting in an outersphere with a diameter of at least 1.68 inches.

A further aspect of the present invention is a non-dimpled golf ball having an innersphere and a plurality of lattice members with apices that define an outersphere. The innersphere has a diameter in the range of 1.60 to 1.70 inches. Each of the lattice members has an apex with a distance from the bottom of each lattice member in a range of 0.005 to 0.010 inch resulting in an outersphere with a diameter of at least 1.68 inches. The entire surface of the golf ball is composed of the plurality of lattice members and a plurality of smooth portions.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
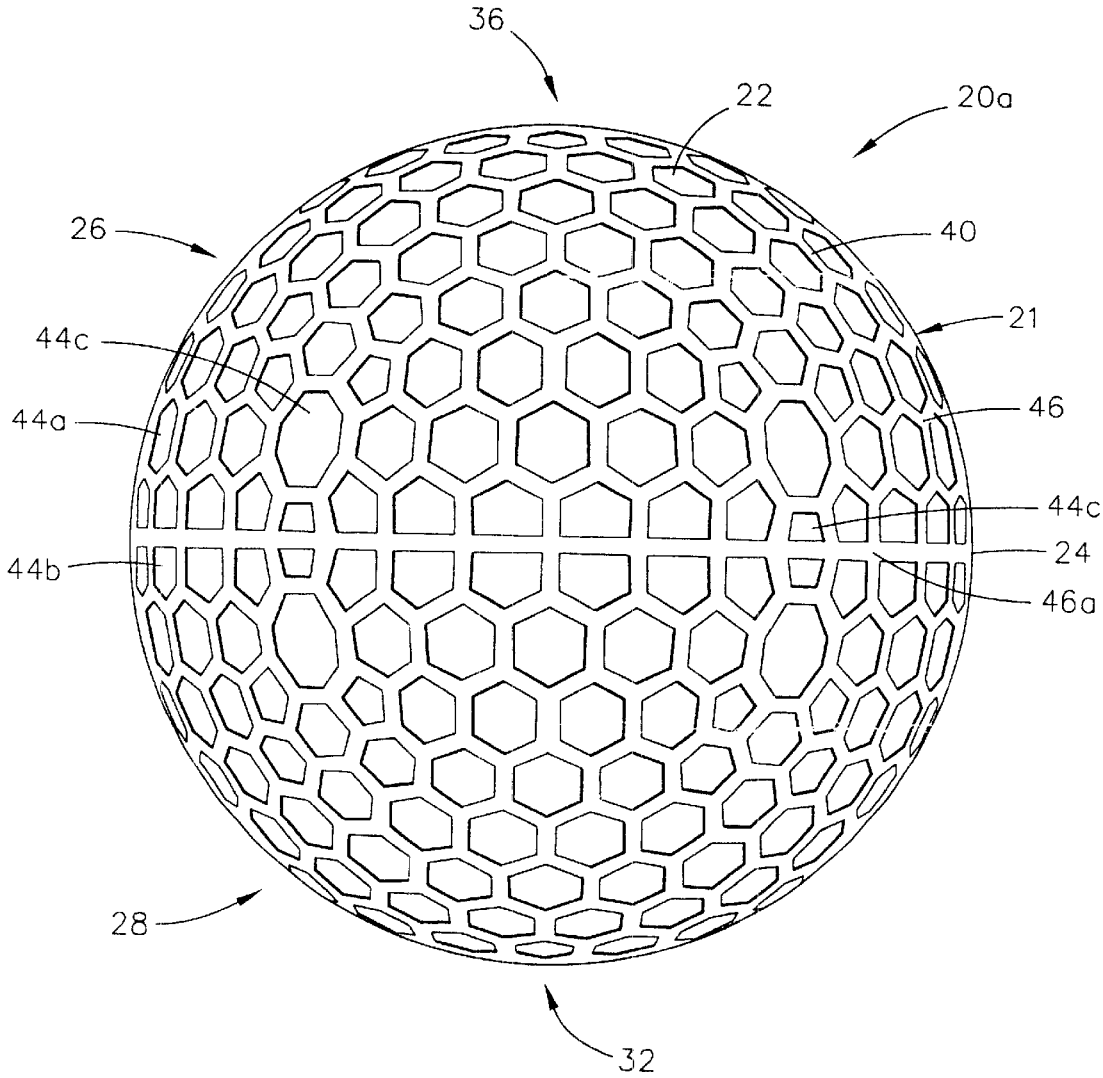
FIG. 1 is an equatorial view of a golf ball of the present invention.
Figure 2:
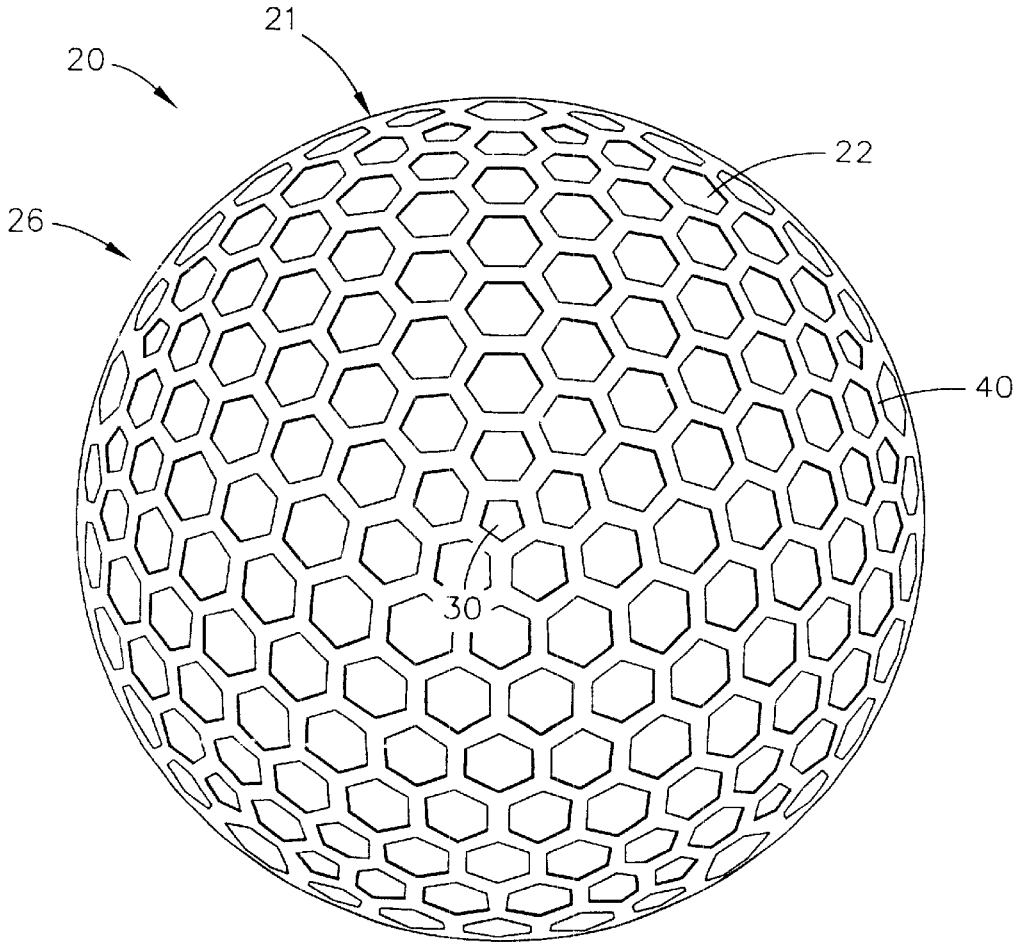
FIG. 2 is a polar view of the golf ball of FIG. 1.
Figure 3:
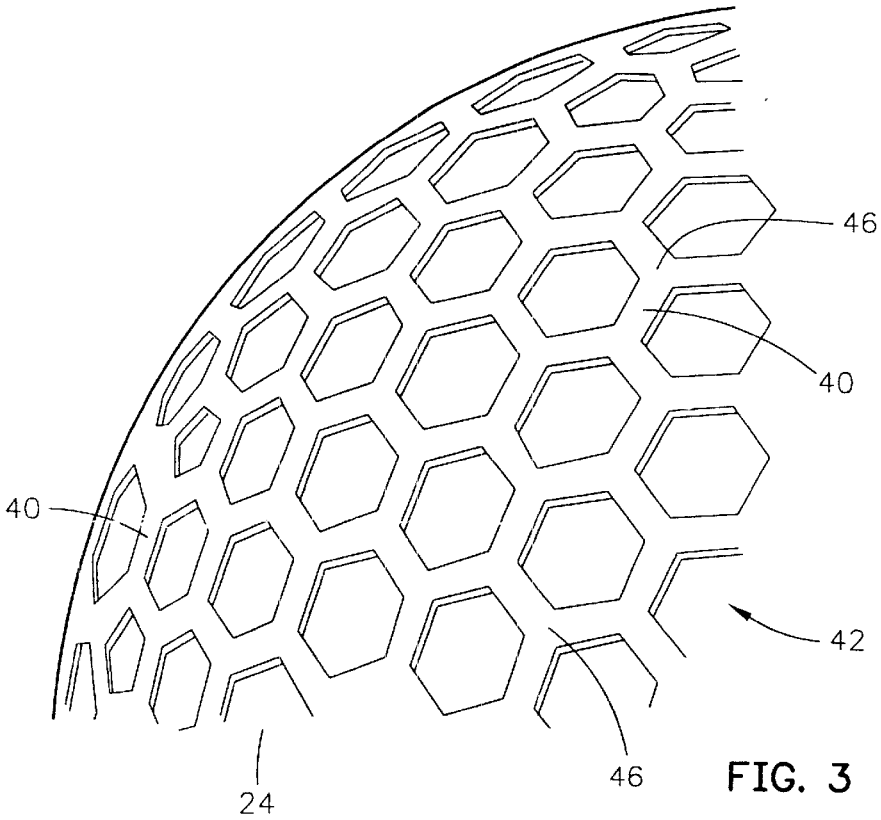
FIG. 3 is an enlargement of a section of FIG. 1.

As shown in FIGS. 1–4, a golf ball is generally designated 20. The golf ball may be a two-piece golf ball, a three piece golf ball, or a multiple layer golf ball. Further, the three-piece golf ball may have a wound layer, or a solid boundary layer. Additionally, the core of the golf ball 20 maybe solid, hollow or filled with a fluid such as a gas or liquid. The cover of the golf ball 20 may be any suitable material. A preferred cover for a three-piece golf ball is composed of a thermoset polyurethane material. A preferred cover material for a two-piece golf ball is a blend of ionomers. However, those skilled in the pertinent art will recognize that other cover materials may be utilized without departing from the scope and spirit of the present invention. The golf ball 20 may have a finish of a basecoat and/or a top coat.

The golf ball 20 has innersphere 21 with an innersphere surface 22. The golf ball 20 also has an equator 24 dividing the golf ball 20 into a first hemisphere 26 and a second hemisphere 28. A first pole 30 is located ninety degrees along a longitudinal arc from the equator 24 in the first hemisphere 26. A second pole 32 is located ninety degrees along a longitudinal arc from the equator 24 in the second hemisphere 28.

Descending toward the surface 22 of the innersphere 21 are a plurality of lattice members 40. In a preferred embodiment, the lattice members 40 are tubular. However, those skilled in the pertinent art will recognize that the lattice members 40 may have other similar shapes. The lattice members 40 are connected to each other to form a lattice structure 42 on the golf ball 20. The interconnected lattice members 40 form a plurality of polygons encompassing discrete areas of the surface 22 of the innersphere 21. Most of these discrete bounded areas 44 are hexagonal shaped bounded areas 44*a*, with a few pentagonal shaped bounded areas 44*b*, a few octagonal shaped bounded areas 44*c*, and a few quadragonal shaped bounded areas 44*d*. In the embodiment of FIGS. 1–4, there are 380 polygons. In the preferred embodiment, each of the plurality of lattice members 40 are connected to at least another lattice members 40. Each of the lattice members 40 meet at least two other lattice members 40 at a vertex 46. Most of the vertices 46 are the congruence of three lattice members 40. However, some vertices 46*a* are the congruence of four lattice members 40. These vertices 46*a* are located at the equator 24 of the golf ball 20. The length of each of the lattice members 40 ranges from 0.005 inch to 0.01 inch thereby defining an outersphere of at least 1.68 inches.

The preferred embodiment of the present invention has reduced the land to almost zero since only a line of each of the plurality of lattice members 40 is in a spherical plane at 1.68 inches, the outersphere. More specifically, the land area of traditional golf balls is the area forming a sphere of at least 1.68 inches for USGA and R&A conforming golf balls. This land area is traditionally minimized with dimples that are concave into the surface of the sphere of the traditional golf ball, resulting in land area on the non-dimpled surface of the golf ball. However, the golf ball 20 of the present invention has only a line at an apex 50 of each of the lattice members 40 that defines the land area of the outersphere of the golf ball 20.

Traditional golf balls were designed to have the dimples "trip" the boundary layer on the surface of a golf ball in flight to create a turbulent flow for greater lift and reduced drag. The golf ball 20 of the present invention has the lattice structure 42 to trip the boundary layer of air about the surface of the golf ball 20 in flight.

Figure 4:
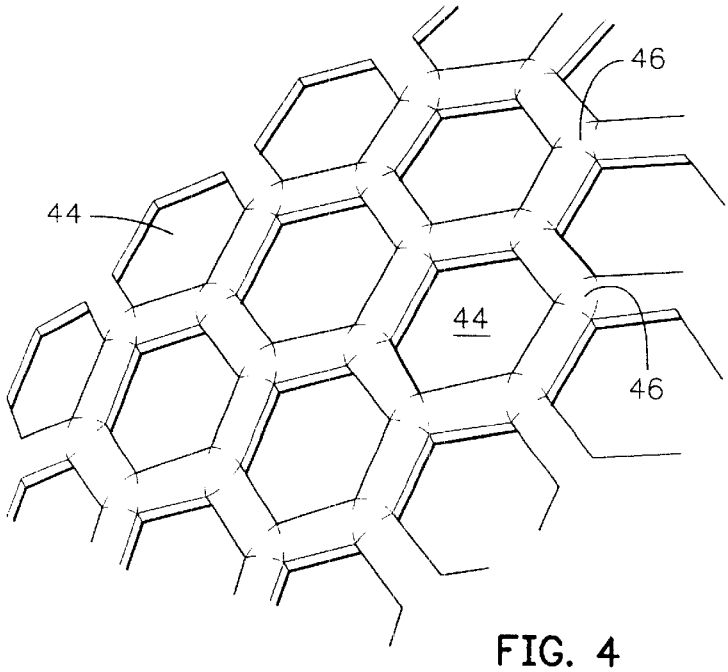
FIG. 4 is an enlargement of a section of FIG. 3
Figure 4A:
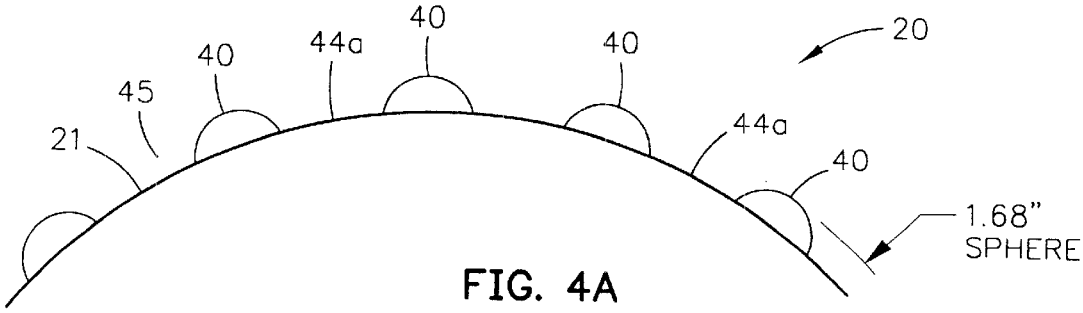
FIG. 4A is a cross-sectional view of the surface of the golf ball of the present invention illustrating an outersphere, also referred to as a phantom sphere.

As shown in FIG. 4A, a 1.68 inches outersphere, as shown by dashed line 45, encompasses the lattice members 40 and the innersphere 21. The volume of the lattice structure 42 as measured from the bottom of each lattice member 40 to the apex 50 is a minimal amount of the volume between the 1.68 inches outersphere and the innersphere 21. In the preferred embodiment, the apex 50 lies on the 1.68 inches outersphere. Thus, over 90 percent, and closer to 95 percent, of the entire volume of the golf ball 20 lies below the 1.68 inches outersphere.

Figure 5:
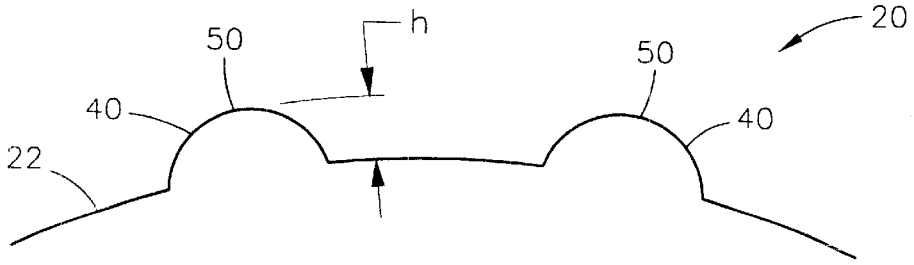
FIG. 5 is a cross-sectional view of one embodiment of lattice members of the golf ball of the present invention.
Figure 6:
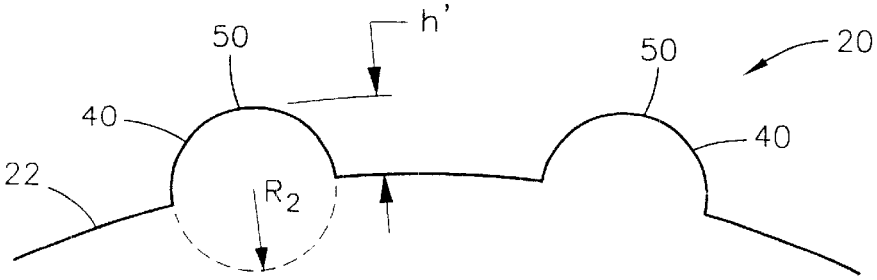
FIG. 6 is a cross-sectional view of an alternative embodiment of lattice members of the golf ball of the present invention.
Figure 6A:
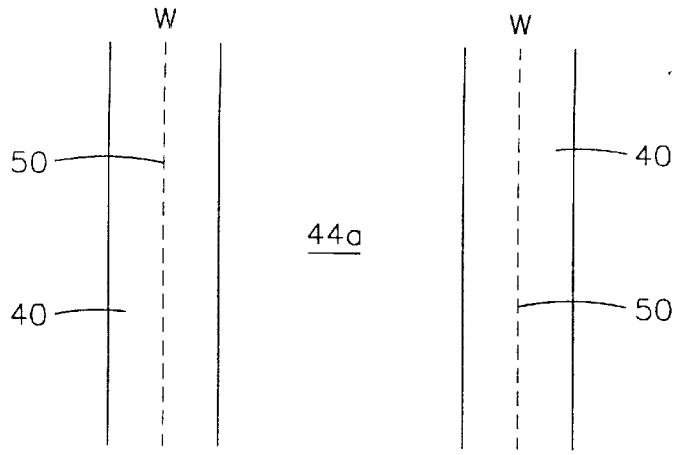
FIG. 6A is a top plan view of FIG. 6 to illustrate the width of the apex of each of the lattice members.

As shown in FIGS. 5 and 6, the distance h and h' of the lattice members 40 from the bottom of each lattice member 40 to an apex 50 will vary in order to have the golf ball 20 meet or exceed the 1.68 inches requirement. For example, if the diameter of the innersphere 21 is 1.666 inches, then the distance h of the lattice members 40 in FIG. 5 is 0.007 inch since the lattice member 40 on one hemisphere 26 is combined with a corresponding lattice member 40 on the second hemisphere 28 to reach the 1.68 inches requirement. In a preferred embodiment, if lattice members 40 having a greater distance h' are desired, such as in FIG. 6, then the innersphere 21 has a lesser diameter. Thus, the diameter of the innersphere 21 in FIG. 6 is 1.662 while the distance h' of the lattice members 40 are 0.009 inch thereby resulting in an outersphere with a diameter of 1.68 inches. As shown in FIG. 6A, the width of each of the apices 50 is minimal since the apex lies along an arc of a lattice member 40. In theory, the width of each apex 50 should approach the width of a line. In practice, the width of each apex 50 of each lattice member 40 is determined by the precision of the mold utilized to produce the golf ball 20. The precision of the mold is itself determined by the master used to form the mold. In the practice, the width of each line ranges from 0.0001 inch to 0.001 inch.

Figure 7:
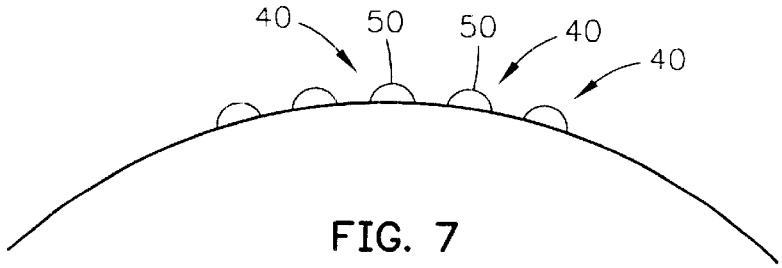
FIG. 7 is an isolated cross-sectional view of one embodiment of lattice members of the golf ball of the present invention.
Figure 8:
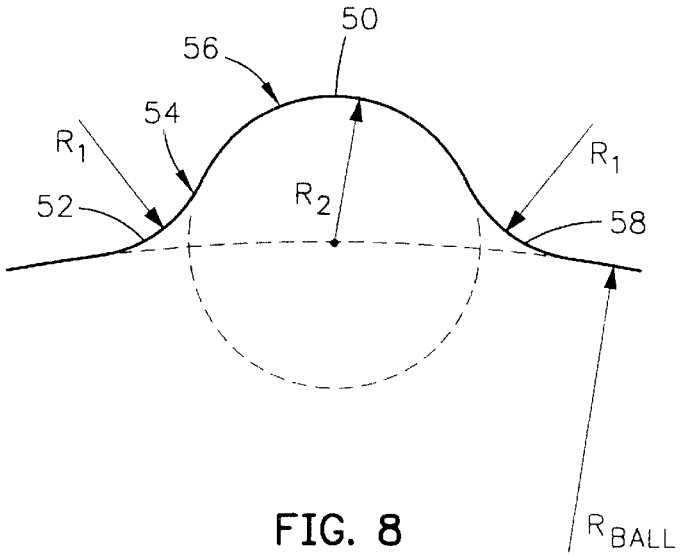
FIG. 8 is a cross-sectional view of a preferred embodiment of lattice members of the golf ball of the present invention.

Although the cross-section of the lattice members 40 shown in FIGS. 5 and 6 are circular, a preferred cross-section of each of the plurality of lattice members 40 is shown in FIGS. 7 and 8. In such a preferred cross-section, the lattice member 40 has a contour 52 that has a first concave section 54, a convex section 56 and a second concave section 58. The radius $R_2$ of the convex portion 56 of each of the lattice members 40 is preferably in the range of 0.0275 inch to 0.0350 inch. The radius $R_1$ of the first and second concave portions 54 and 58 is preferably in the range of 0.150 inch to 0.200 inch, and most preferably 0.175 inch. $R_{IS}$ is the radius of the innersphere, which is preferably 0.831 inch. $R_{OS}$ is the radius of the outersphere, which is preferably 1.68 inches.

A preferred embodiment of the present invention is illustrated in FIGS. 9, 9A, 9B and 9C. In this embodiment, the golf ball 20 has a parting line 100 that corresponds to the shape of polygon defined by the plurality of lattice members 40 about the equator 24. Thus, if the polygons have a hexagonal shape, the parting line 100 will alternate along the lower half of one hexagon and the upper half of an adjacent hexagon. Such a golf ball 20 is fabricated using a mold such as disclosed in co-pending U.S. patent application Ser. No. 09/442,845, filed on Nov. 18, 1999, entitled Mold For A Golf Ball, and incorporated herein by reference. The preferred embodiment allows for greater uniformity in the polygons. In the embodiment of FIGS. 9, 9A, 9B and 9C, there are 332 polygons, with 12 of those polygons being pentagons and the rest being hexagons.

Figure 9:
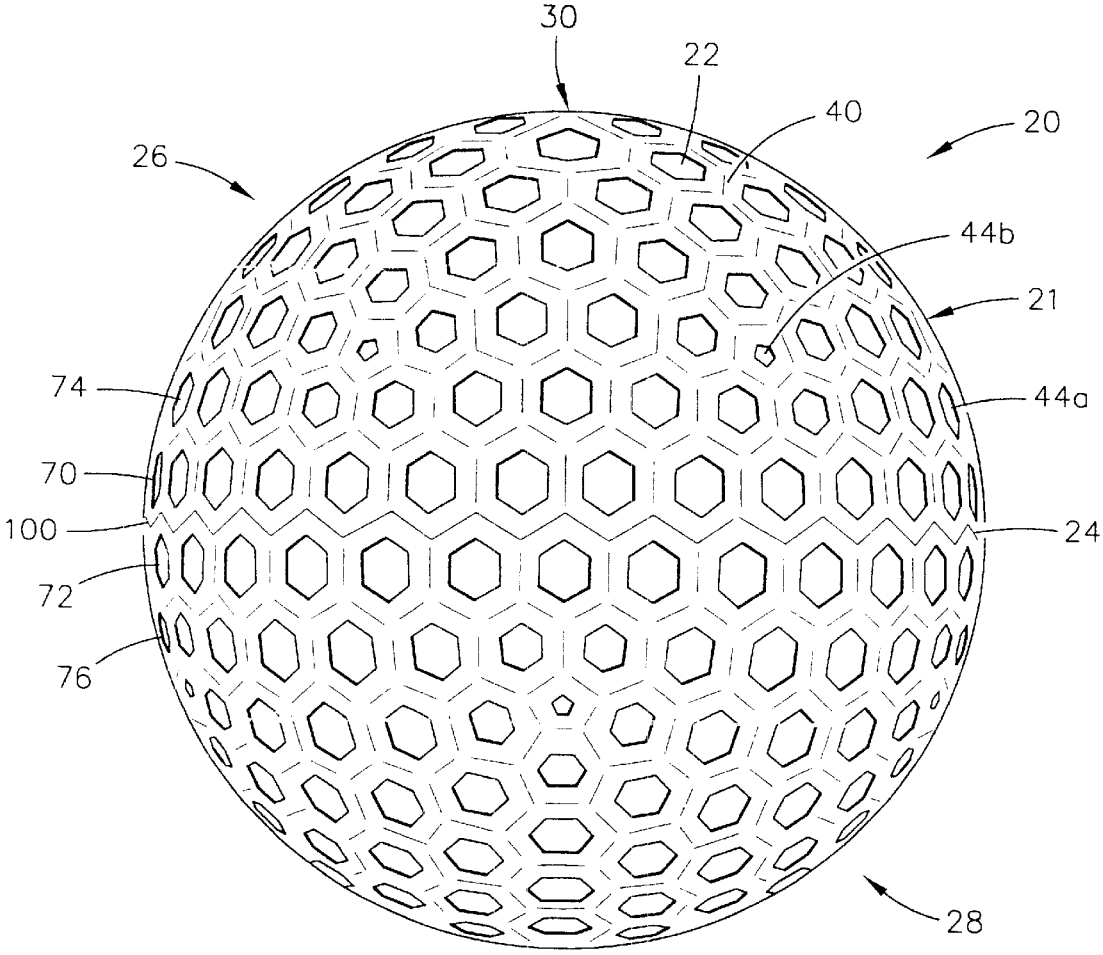
FIG. 9 is a front view of the preferred embodiment of the golf ball of the present invention illustrating the alternating parting line.
Figure 9A:
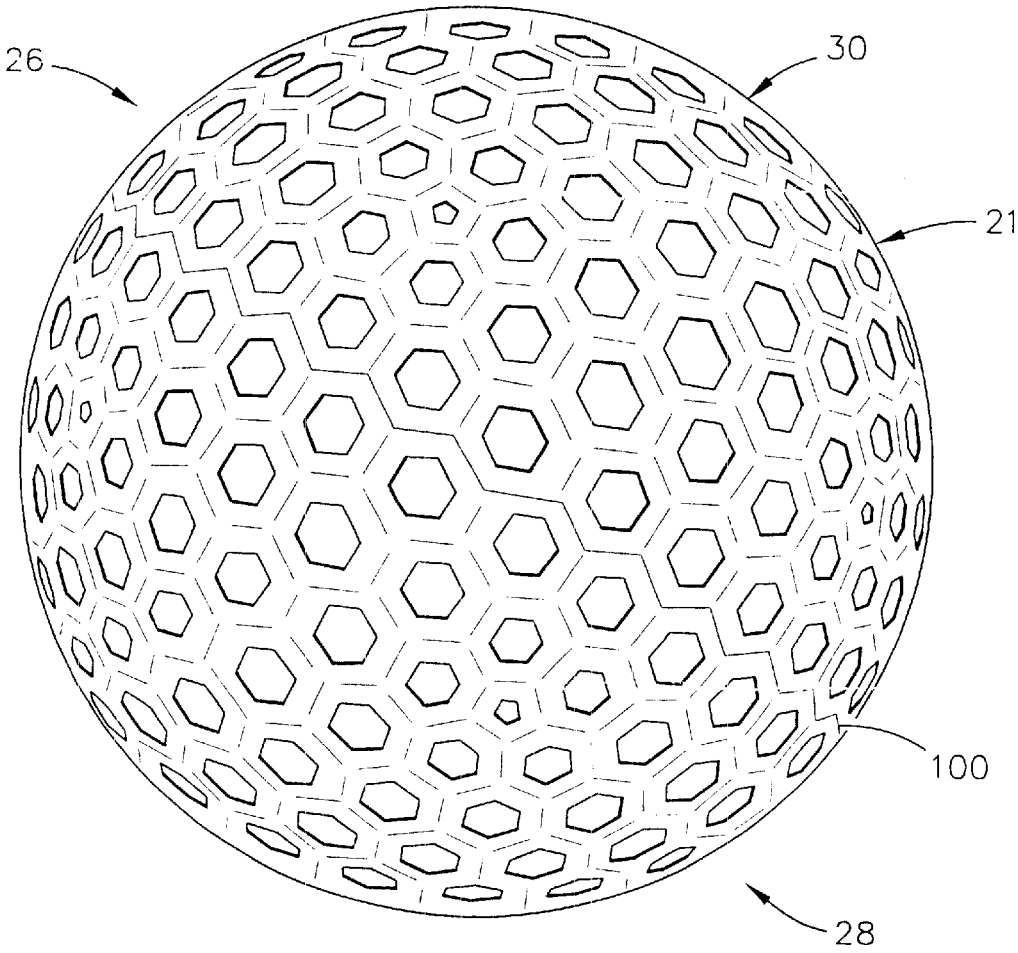
FIG. 9A is a perspective view of the golf ball of FIG. 9.
Figure 9B:
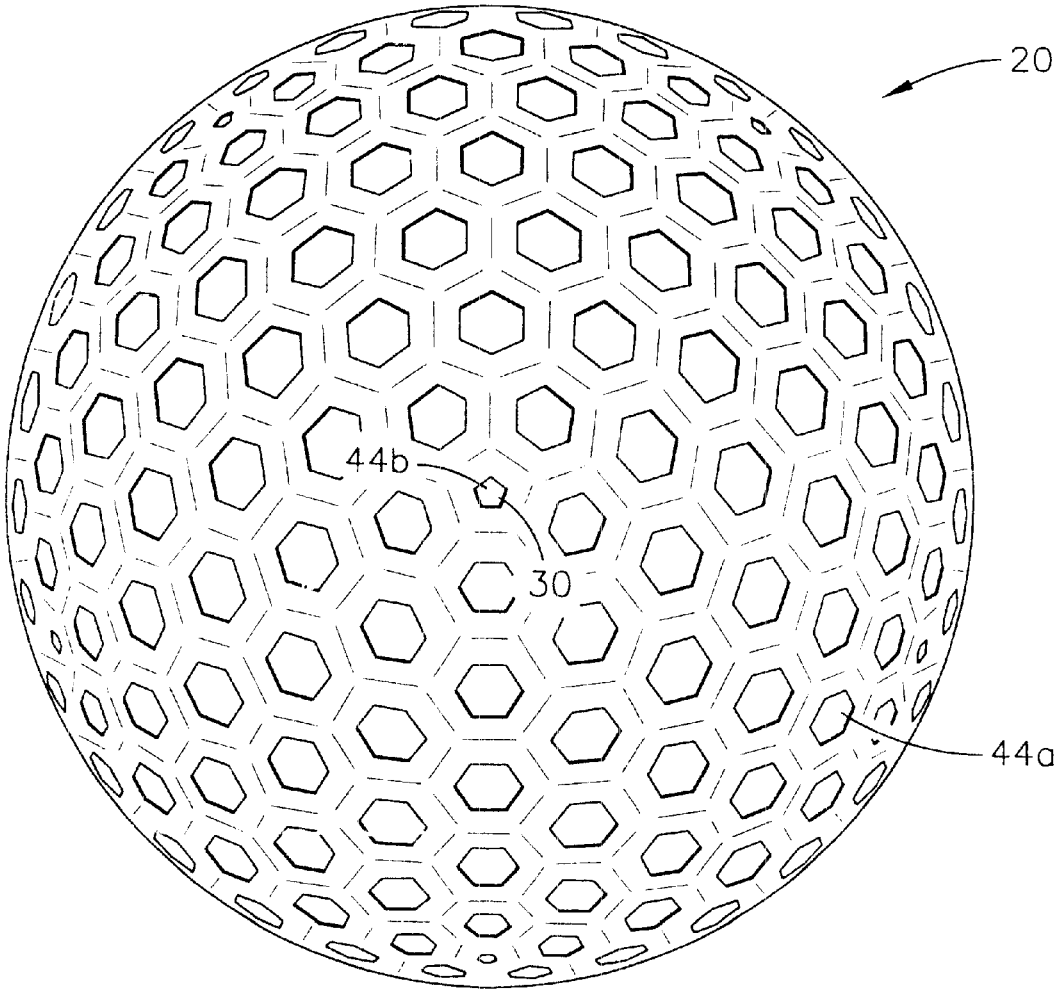
FIG. 9B is a polar view of the golf ball of FIG. 9.
Figure 9C:
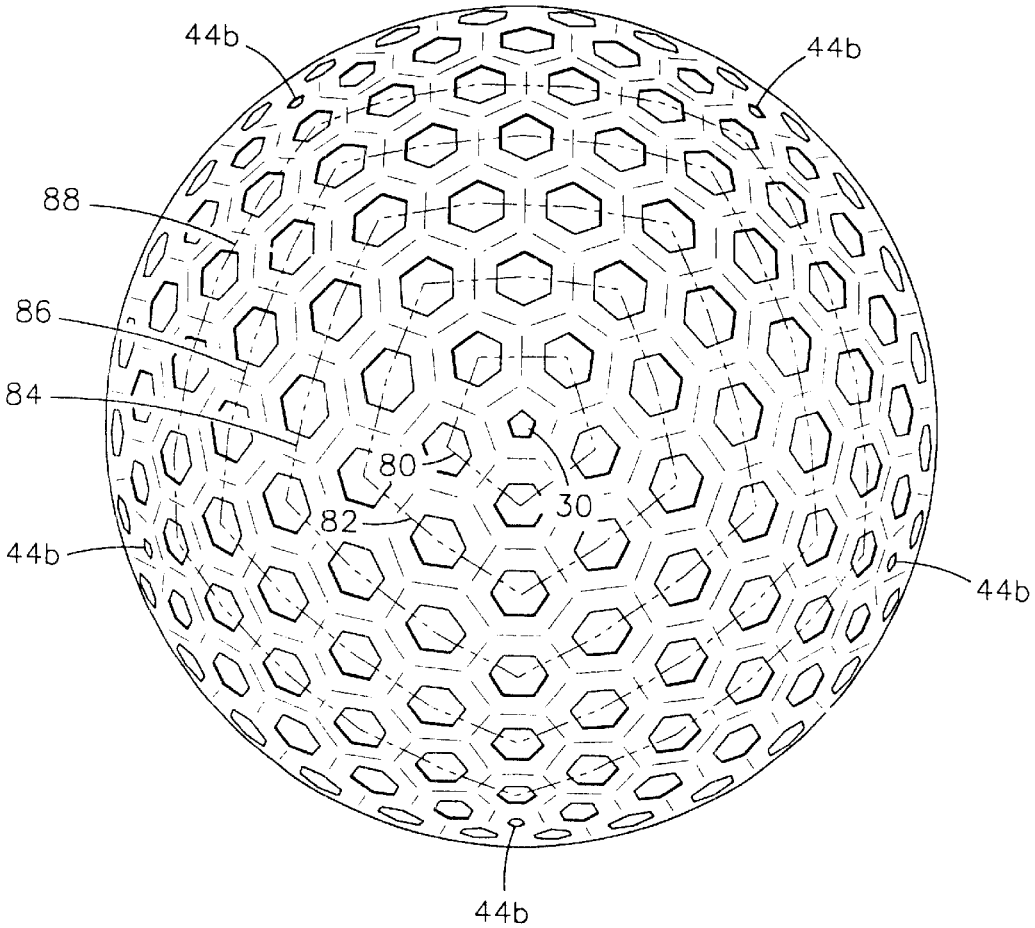
FIG. 9C is an identical view of FIG. 9 illustrating the pentagonal grouping of hexagons.

As shown in FIG. 9, each hemisphere 26 and 28 has two rows of hexagons 70, 72, 74 and 76, adjacent the parting line 100. The pole 30 of the first hemisphere 26 is encompassed by a pentagon 44*b*, as shown in FIG. 9B. The pentagon 44*b* at the pole 30 is encompassed by ever increasing spherical pentagonal groups of hexagons 80, 82, 84, 86, and 88. A pentagonal group 90 has pentagons 44*b* at each respective base, with hexagons 44*a* therebetween. The pentagonal groups 80, 82, 84, 86, 88 and 90 transform into the four adjacent rows 70, 72, 74 and 76. The preferred embodiment only has hexagons 44*a* and pentagons 44*b*.

Figure 10:
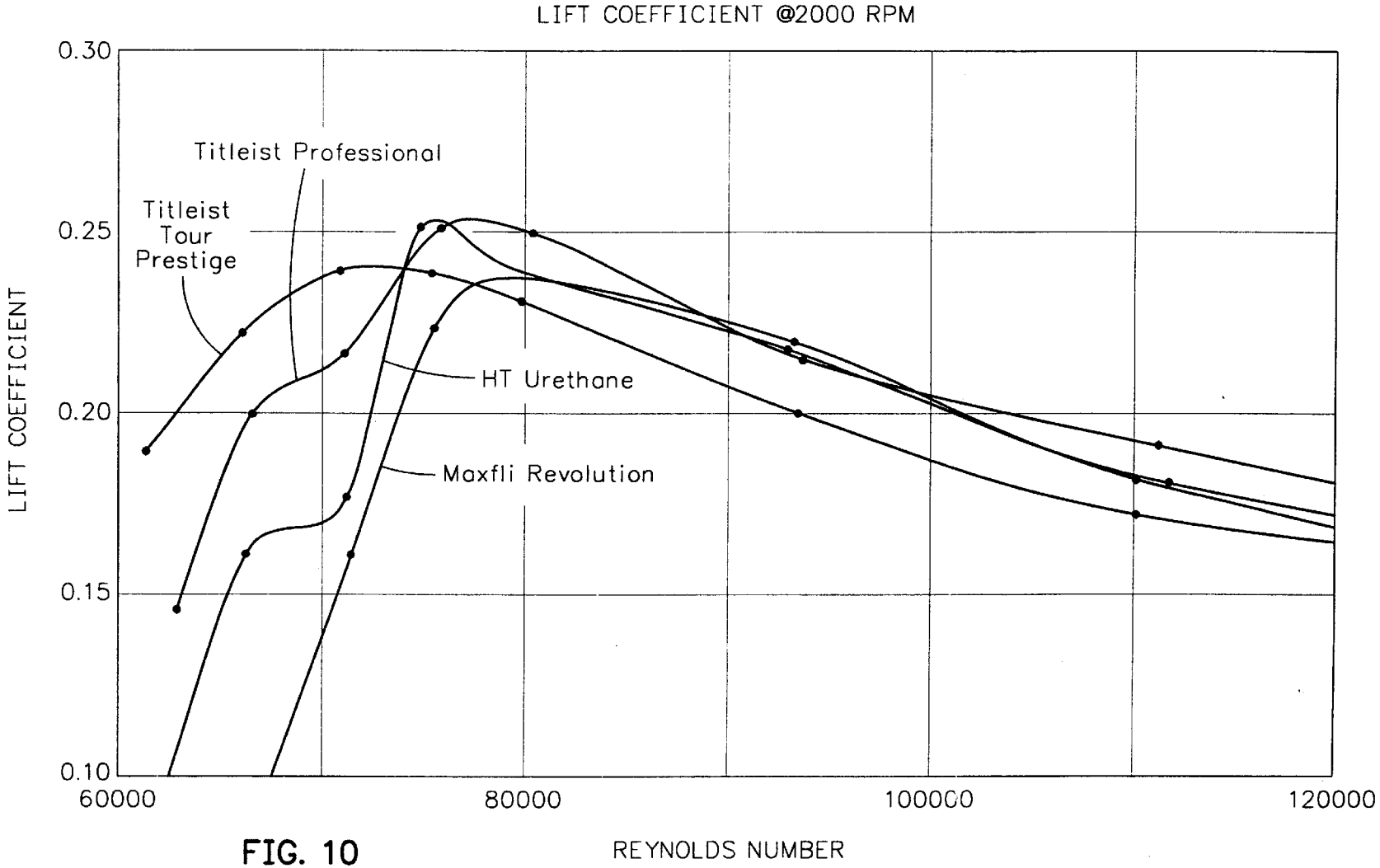
FIG. 10 is a graph of the lift coefficient versus Reynolds number for traditional golf balls.
Figure 11:
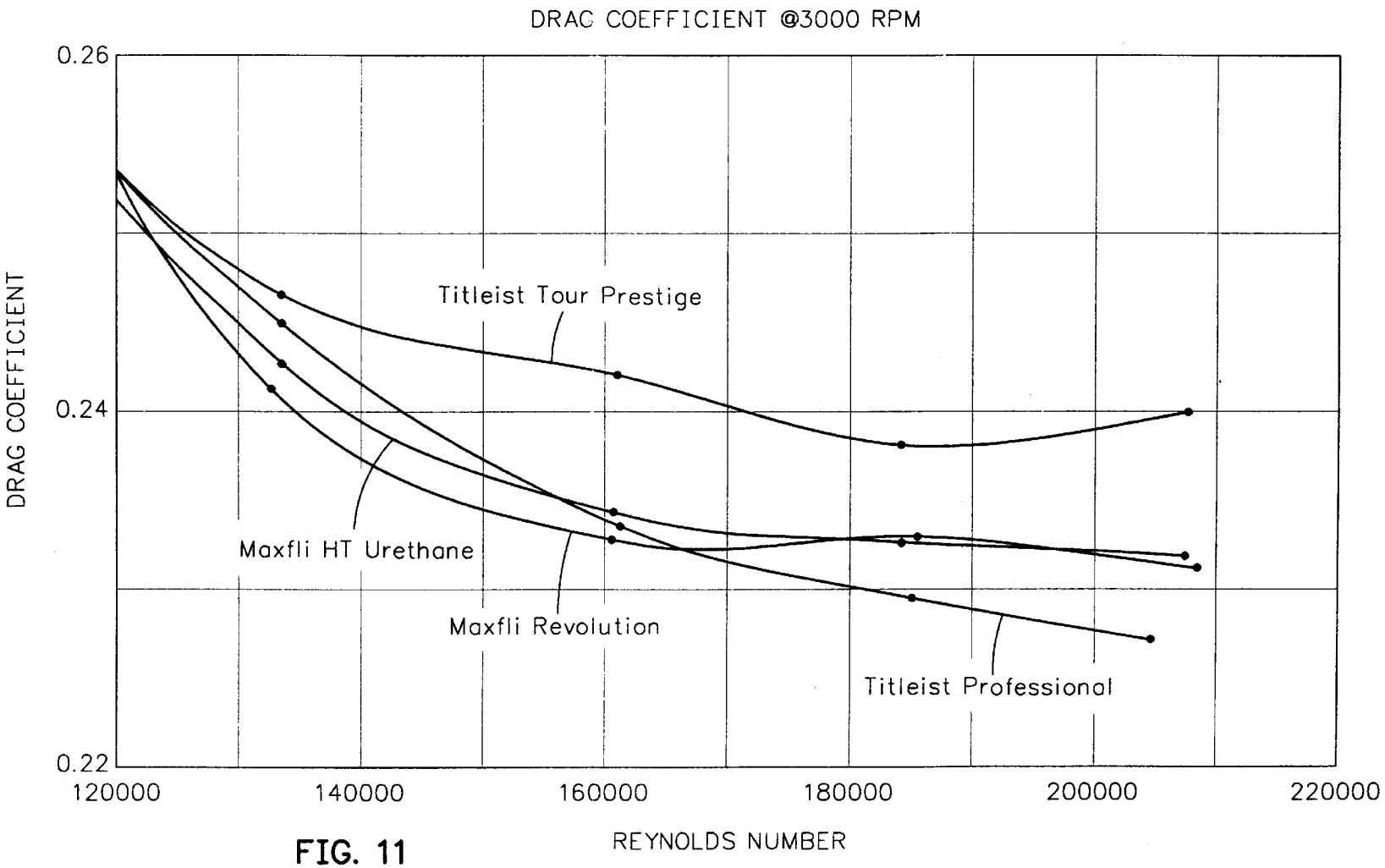
FIG. 11 is graph of the drag coefficient versus Reynolds number for traditional golf balls.
Figure 12:
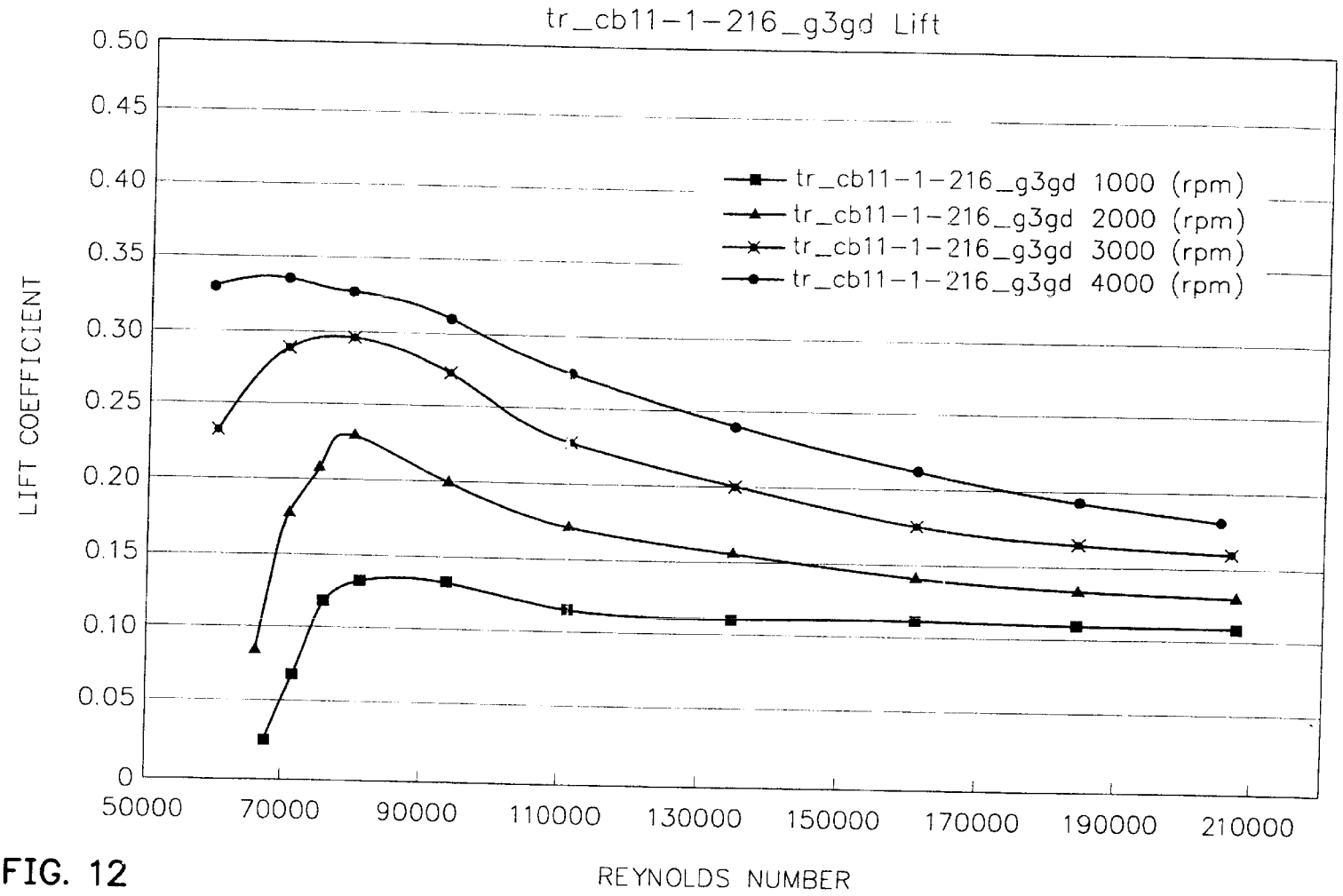
FIG. 12 is a graph of the lift coefficient versus Reynolds number for the golf ball of the present invention for four different backspins.
Figure 13:
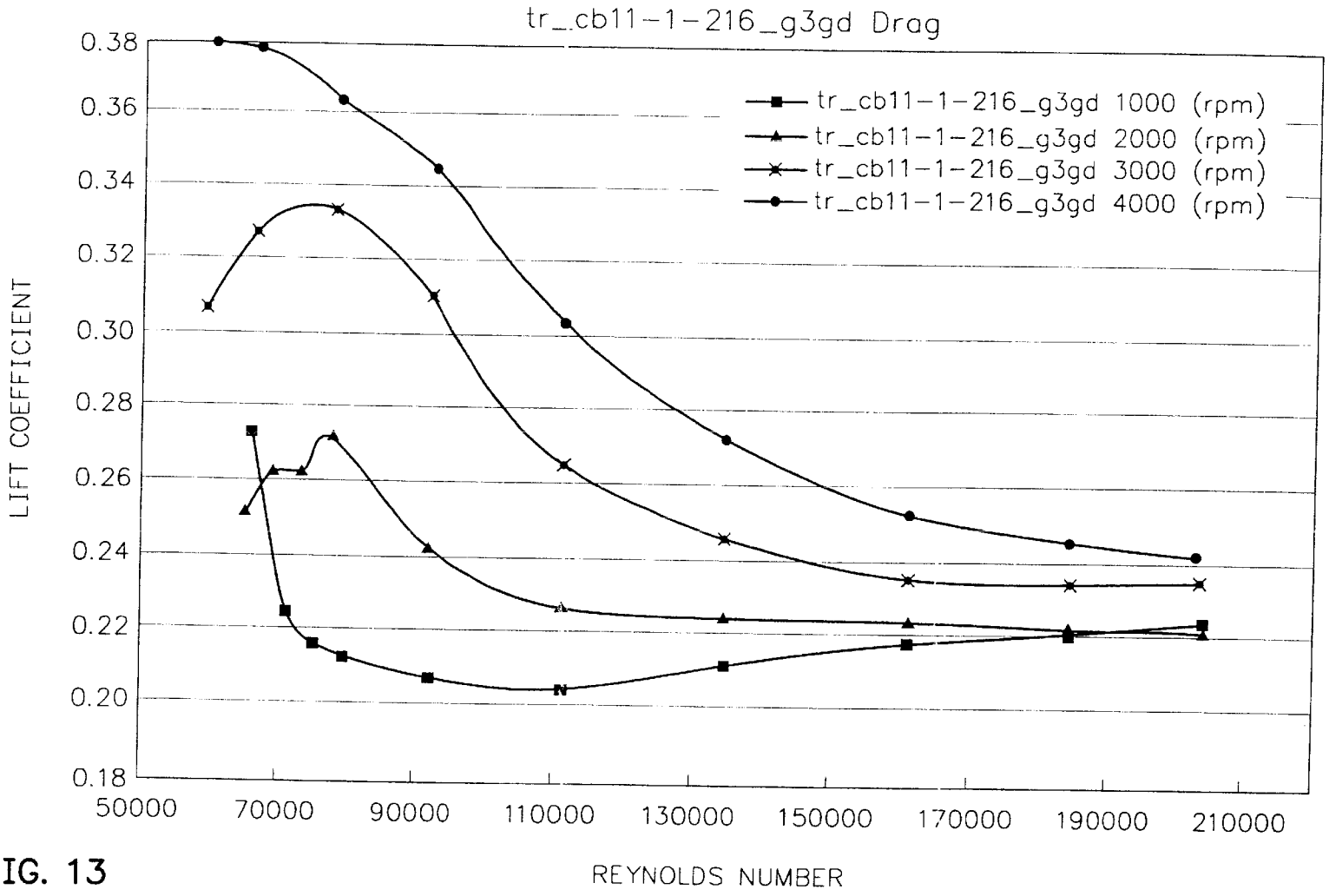
FIG. 13 is graph of the drag coefficient versus Reynolds number for the golf ball of the present invention for four different backspins.

FIGS. 10 and 11 illustrate the lift and drag of traditional golf balls at a backspin of 2000 rpm and 3000 rpm, respectively. FIGS. 12 and 13 illustrate the lift and drag of the present invention at four different backspins. The force acting on a golf ball in flight is calculated by the following trajectory equation:

$$F=F_L+F_D+G \quad (A)$$

wherein F is the force acting on the golf ball; $F_L$ is the lift; $F_D$ is the drag; and G is gravity. The lift and the drag in equation A are calculated by the following equations:

$$F_L=0.5C_LA\rho v^2 \quad (B)$$

$$F_D=0.5C_DA\rho v^2 \quad (C)$$

wherein $C_L$ is the lift coefficient; $C_D$ is the drag coefficient; A is the maximum cross-sectional area of the golf ball; ρ is the density of the air; and ν is the golf ball airspeed.

The drag coefficient, $C_D$, and the lift coefficient, $C_L$, may be calculated using the following equations:

$$C_{D=2}F_D/A\rho v^2 \quad (D)$$

$$C_{L=2}F_L/A\rho v^2 \quad (E)$$

The Reynolds number R is a dimensionless parameter that quantifies the ratio of inertial to viscous forces acting on an object moving in a fluid. Turbulent flow for a dimpled golf ball occurs when R is greater than 40000. If R is less than 40000, the flow may be laminar. The turbulent flow of air about a dimpled golf ball in flight allows it to travel farther than a smooth golf ball.

The Reynolds number R is calculated from the following equation:

$$R=vD\rho/\mu \quad (F)$$

wherein v is the average velocity of the golf ball; D is the diameter of the golf ball (usually 1.68 inches); ρ is the density of air (0.00238 slugs/ft$^3$ at standard atmospheric conditions); and $\mu$ is the absolute viscosity of air ($3.74\times10^{-7}$ lb*sec/ft$^2$ at standard atmospheric conditions). A Reynolds number, R, of 180,000 for a golf ball having a USGA approved diameter of 1.68 inches, at standard atmospheric conditions, approximately corresponds to a golf ball hit from the tee at 200 ft/s or 136 mph, which is the point in time during the flight of a golf ball when the golf ball attains its highest speed. A Reynolds number, R, of 70,000 for a golf ball having a USGA approved diameter of 1.68 inches, at standard atmospheric conditions, approximately corresponds to a golf ball at its apex in its flight, 78 ft/s or 53 mph, which is the point in time during the flight of the golf ball when the travels at its slowest speed. Gravity will increase the speed of a golf ball after its reaches its apex.

FIG. 10 illustrates the lift coefficient of traditional golf balls such as the Titlelist PROFESSIONAL, the Titlelist TOUR PRESTIGE, the Maxfli REVOLUTION and the Maxfli HT URETHANE. FIG. 11 illustrates the drag coefficient of traditional golf balls such as the Titlelist PROFESSIONAL, the Titlelist TOUR PRESTIGE, the Maxfli REVOLUTION and the Maxfli HT URETHANE.

All of the golf balls for the comparison test, including the golf ball 20 of the present invention, have a thermoset polyurethane cover. The golf ball 20 of the present invention was constructed as set forth in U.S. Pat. No. 6,117,024, filed on Jul. 27, 1999, for a Golf Ball With A Polyurethane Cover which pertinent parts are hereby incorporated by reference. However, those skilled in the pertinent art will recognize that other materials may be used in the construction of the golf ball of the present invention. The aerodynamics of the lattice structure 42 of the present invention provides a greater lift with a reduced drag thereby translating into a golf ball 20 that travels a greater distance than traditional golf balls of similar constructions.

As compared to traditional golf balls, the golf ball 20 of the present invention is the only one that combines a lower drag coefficient at high speeds, and a greater lift coefficient at low speeds. Specifically, as shown in FIGS. 10–13, none of the other golf balls have a lift coefficient, $C_L$ greater than 0.18 at a Reynolds number of 70,000, and a drag coefficient $C_D$ less than 0.23 at a Reynolds number of 180,000. For example, while the Titliest PROFESSIONAL has a $C_L$ greater than 0.18 at a Reynolds number of 70,000, its $C_D$ is greater than 0.23 at a Reynolds number of 180,000. Also, while the Maxfli REVOLUTION has a drag coefficient $C_D$ greater than 0.23 at a Reynolds number of 180,000, its $C_L$ is less than 0.18 at a Reynolds number of 70,000.

In this regard, the Rules of Golf, approved by the USGA and the R&A, limit the initial velocity of a golf ball to 250 feet (76.2m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org or at the R&A web page at www.randa.org. Thus, the initial velocity and overall distance of a golf ball must not exceed these limits in order to conform to the Rules of Golf. Therefore, the golf ball 20 should have a dimple pattern that enables the golf ball 20 to meet, yet not exceed, these limits.

Figure 14:
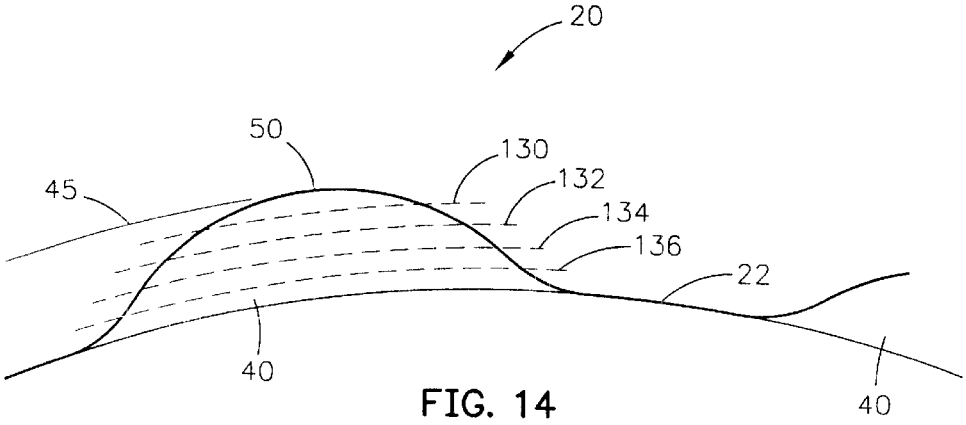
FIG. 14 is an enlarged view of the surface of a golf ball of the present invention to demonstrate the minimal volume feature of the present invention.

FIG. 14 is an enlarged view of the surface of the golf ball 20 of the present invention to demonstrate the minimal volume of the golf ball 20 from a predetermined distance from the greatest extent of the golf ball 20, the outersphere. More specifically, the greatest extent of one embodiment of the golf ball 20 are the apices 50 of the lattice members 40 which lie on a spherical plane (shown as dashed line 45) which has a 1.682 inches diameter, the outersphere. Those skilled in the art should recognize that other embodiments could have the apices 50 lie on a spherical plane at 1.70 inches, 1.72 inches, 1.64 inches, 1.60 inches, or any other variation in the diameter of the greatest extent of the golf ball 20. Having defined the greatest extent of the golf ball 20, the present invention will have a minimal volume from this greatest extent toward the innersphere 22. For example, dashed line 130 represents a spherical plane that intersects each of the lattice members 40 at a distance of 0.002 inch (at a radius of 0.839 inch from the center) from the greatest extent of the golf ball 20. The volume of the golf ball 20 of the present invention between the greatest extent spherical plane 45 and the spherical plane 130 is only 0.0008134 cubic inch. In other words, the outermost 0.002 inch (between a radius of 0.841 and 0.839 inch) of the golf ball 20 has a volume 0.0008134 cubic inch.

Figure 15:
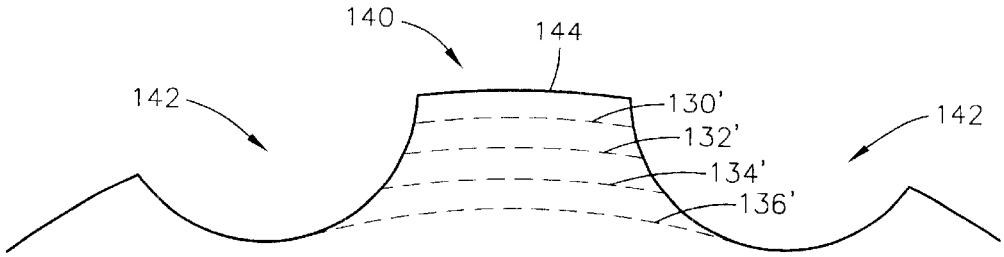
FIG. 15 (PRIOR ART)
FIG. 15 is an enlarged view of the surface of a golf ball of the prior art for comparison to the minimal volume feature of the present invention.

FIG. 15 illustrates the surface of a golf ball 140 of the prior art which has traditional dimples 142 encompassed by a land area 144. The land area 144 represents the greatest extent of the golf ball 140 of the prior art. For comparison to the golf ball 20 of the present invention, the volume of the golf ball 140 of the prior art between the greatest extent 144 and a spherical plane 130' is 0.00213 cubic inch. Spherical planes 132, 134 and 136, at 0.004 inch, 0.006 inch and 0.008 inch respectively, have volumes of 0.0023074 cubic inch, 0.0042164 cubic inch and 0.0065404 cubic inch, respectively on the golf ball 20 of the present invention. Spherical planes 132', 134' and 136', at 0.004 inch, 0.006 inch and 0.008 inch respectively, will have volumes of 0.00498 cubic inch, 0.00841 cubic inch and 0.01238 cubic inch on the golf ball 140 of the prior art 140.

Figure 16:
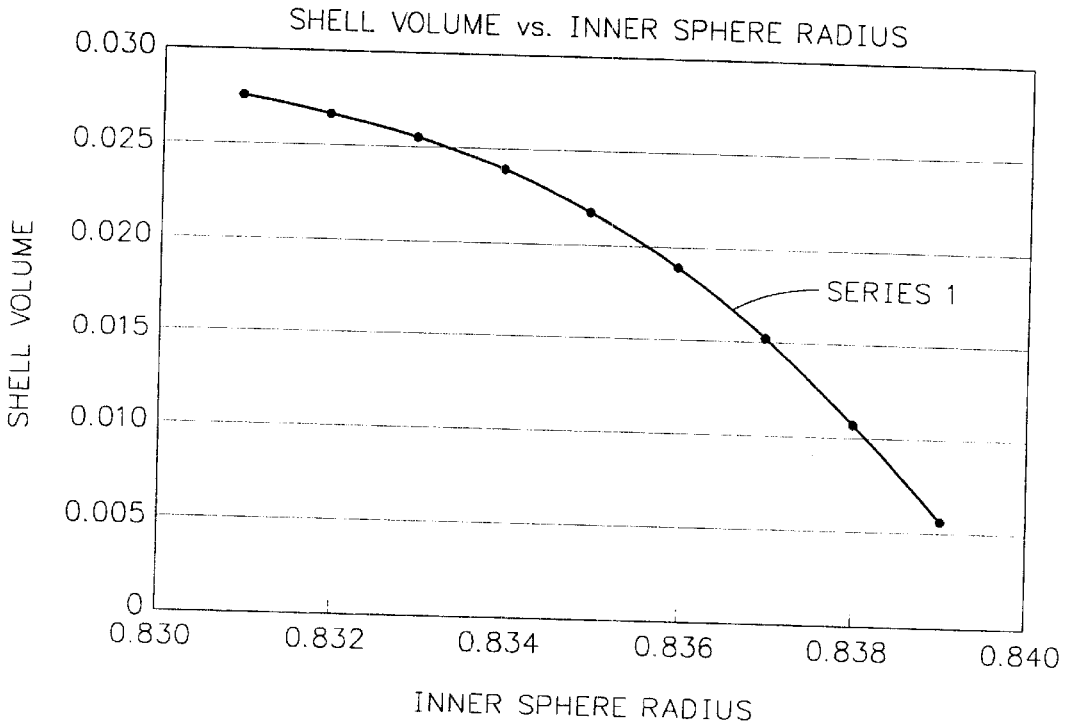
FIG. 16 is a chart of the minimal volume.

Thus, as further shown in FIG. 16 and Table One below, the golf ball 20 of the present invention will have a minimal volume at a predetermined distance from the greatest extent of the golf ball 20. This minimal volume is a minimal amount necessary to trip the boundary layer air at low speed while providing a low drag level at high speeds. The first column of Table One is the distance from the outermost point of the golf ball 20, which is the apex 50 of each of the lattice members 40. The second column is the individual volume of each of the 830 lattice members 40 at this distance inward from the outermost point. The third column is the total volume of the spherical planes at each distance inward from the outermost point. Table Two contains similar information for the golf ball 140 of the prior art.

TABLE ONE

| Tube H | Tube Vol | Total Volume |
|---|---|---|
| 0.001 | 0.00000035 | 0.0002905 |
| 0.002 | 0.00000098 | 0.0008134 |
| 0.003 | 0.00000181 | 0.0015023 |
| 0.004 | 0.00000278 | 0.0023074 |
| 0.005 | 0.00000387 | 0.0032121 |
| 0.006 | 0.00000508 | 0.0042164 |
| 0.007 | 0.00000641 | 0.0053203 |
| 0.008 | 0.00000788 | 0.0065404 |
| 0.009 | 0.00001123 | 0.0093209 |

TABLE TWO

| Shell Delta Dia. | 1/10 Remaining Vol | Total Remaining Vol |
|---|---|---|
| 0.001 | 0.000091 | 0.00091 |
| 0.002 | 0.000213 | 0.00213 |
| 0.003 | 0.000347 | 0.00347 |
| 0.004 | 0.000498 | 0.00498 |
| 0.005 | 0.000663 | 0.00663 |
| 0.006 | 0.000841 | 0.00841 |
| 0.007 | 0.001033 | 0.01033 |
| 0.008 | 0.001238 | 0.01238 |
| 0.009 | 0.001458 | 0.01458 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball comprising:

an innersphere having a surface;

a plurality of smooth portions on the surface of the innersphere; and a plurality of lattice members encompassing the plurality of smooth portions, each of the lattice members having a cross-sectional curvature comprising a first concave portion, a second concave portion and a convex portion disposed between the first concave portion and the second concave portion, the convex portion having an apex tangent to the curvature of the convex portion, each of the plurality of lattice members connected to at least one other lattice member to form a predetermined pattern of polygons about the plurality of smooth portions, each of the lattice members having an apex at a distance of from 0.005 inch to 0.010 inch from the bottom of the lattice member thereby defining an outersphere.

2. The golf ball according to claim 1 wherein the plurality of lattice members cover between 20% to 80% of the golf ball.

3. The golf ball according to claim 1 wherein each of the plurality of lattice members has an apex with a width less than 0.00001 inch.

4. The golf ball according to claim 3 wherein the diameter of the innersphere is at least 1.67 inches and the distance of the apex of each of the plurality of lattice members is at least 0.005 inch from the bottom of the lattice member.

5. The golf ball according to claim 1 wherein the each of the plurality of polygons is either a hexagon or a pentagon.

* * * * *

UNITED STATES PATENT AND TRADEMARK OFFICE

CERTIFICATE OF CORRECTION

PATENT NO. : 6,461,253 B2
DATED : October 8, 2002
INVENTOR(S) : Ogg

It is certified that error appears in the above-identified patent and that said Letters Patent is hereby corrected as shown below:

Drawings,
FIG. 10 should be replaced with the attached FIG. 10.
FIG. 11 should be replaced with the attached FIG. 11.
FIG. 13, the Y-axis "LIFT COEFFICIENT" should be -- DRAG COEFFICIENT --.

Column 8,
Line 7, "FIGS. 10-13" should be -- FIGS. 10 and 11 --.
Line 8, "have" should be -- has --.

Signed and Sealed this

Twenty-second Day of February, 2005

JON W. DUDAS
*Director of the United States Patent and Trademark Office*

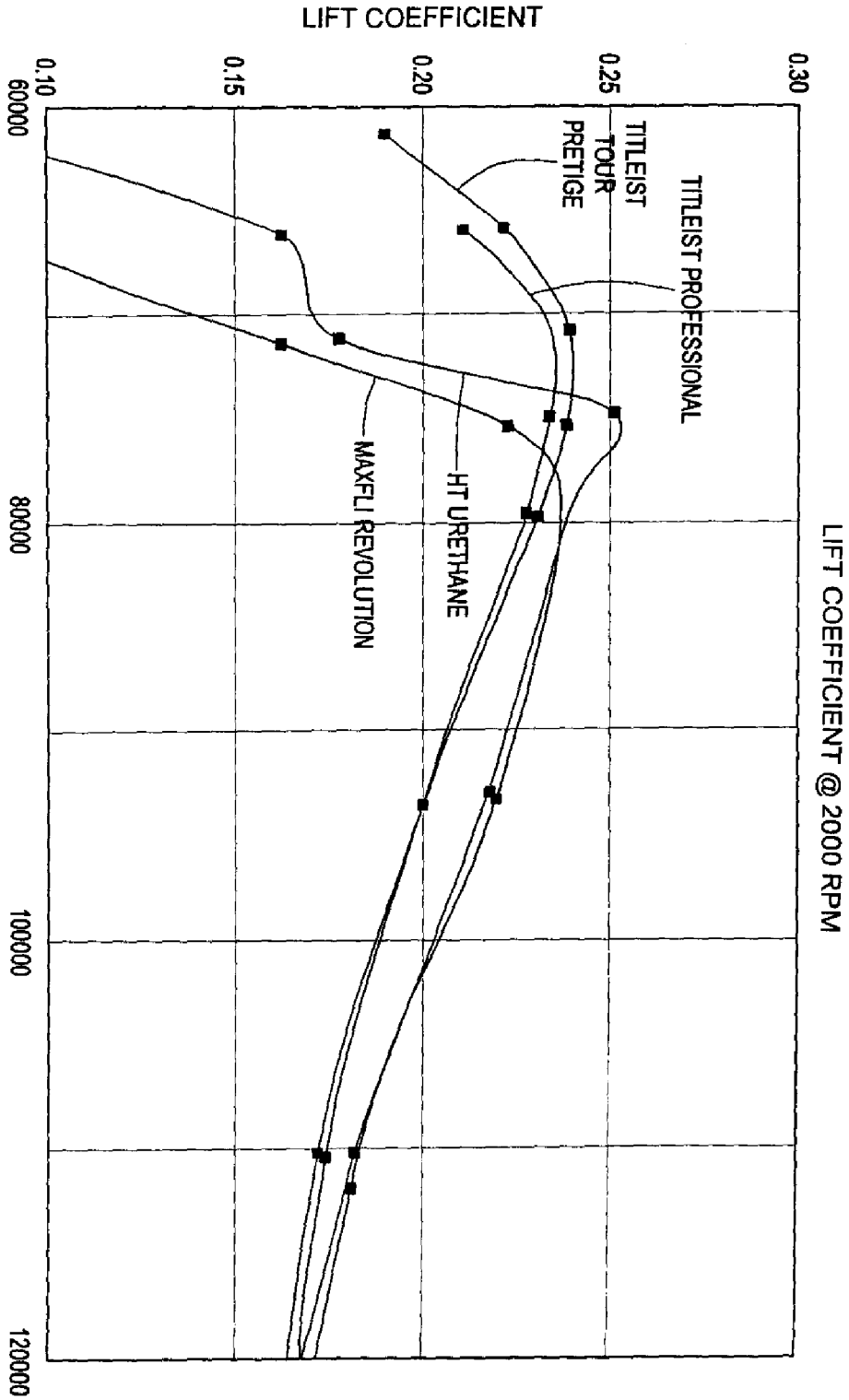
FIG. 10
(AMENDED)

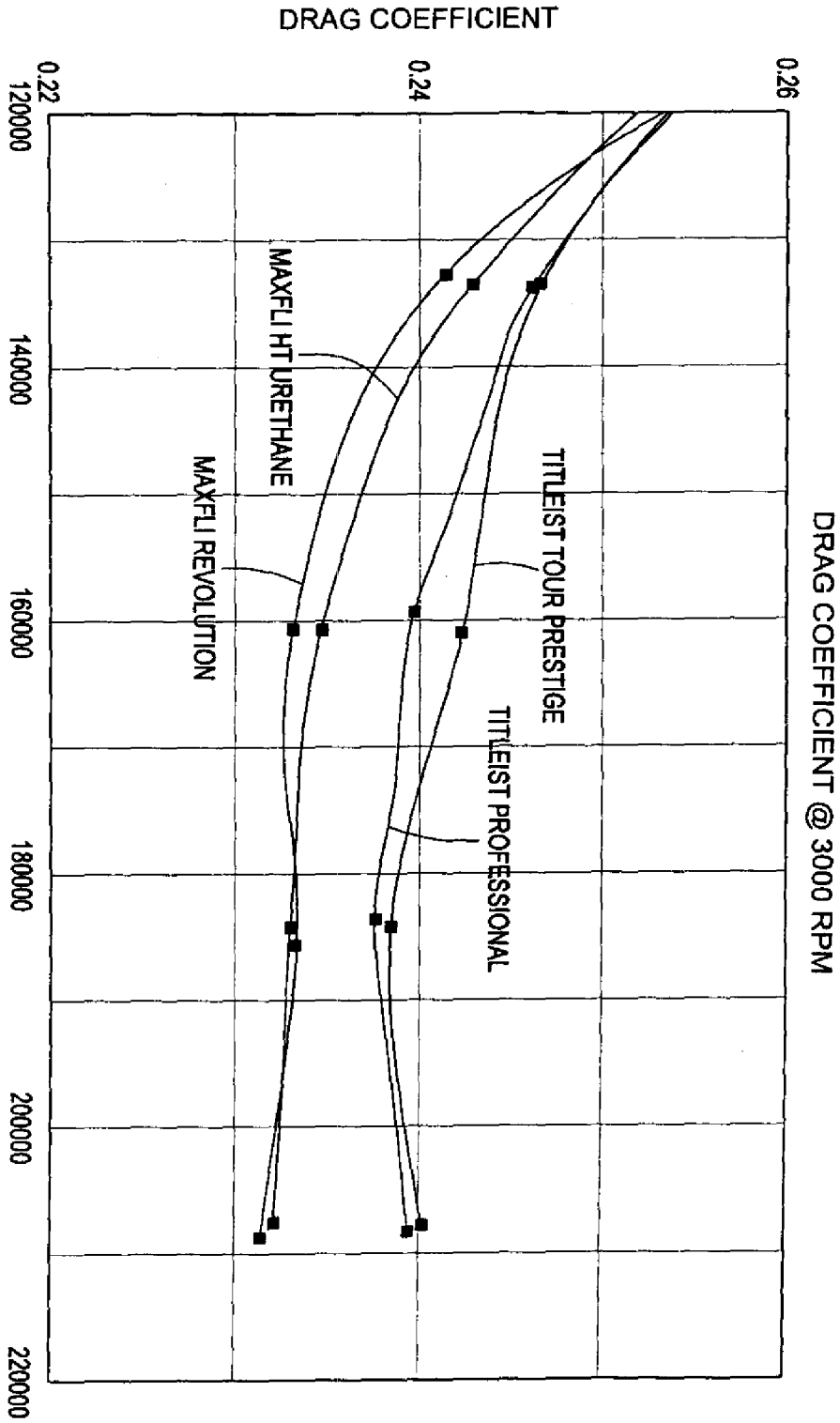
*FIG. 11*
*(AMENDED)*